US005950957A

United States Patent [19]

Stiller

[11] Patent Number: 5,950,957

[45] Date of Patent: Sep. 14, 1999

[54] BOBBIN WINDING UNIT OF A TEXTILE MACHINE FOR PRODUCING CROSS-WOUND BOBBINS

[75] Inventor: Joachim Stiller, Wegberg, Germany

[73] Assignee: W. Schlafhorst AG & Co., Monchengladbach, Germany

[21] Appl. No.: 08/985,421

[22] Filed: Dec. 4, 1997

[30] Foreign Application Priority Data

Dec. 7, 1996 [DE] Germany ..... 196 50 933

[51] Int. Cl.[6] ..... B65H 54/02

[52] U.S. Cl. ..... 242/475.5; 242/475.1

[58] Field of Search ..... 242/475.1, 475.2, 242/475.4, 475.5

[56] References Cited

U.S. PATENT DOCUMENTS

| | | | |
|---|---|---|---|
| 3,918,651 | 11/1975 | Uchida | 242/475.5 |
| 4,986,482 | 1/1991 | Okayama | 242/475.4 |
| 5,082,194 | 1/1992 | Grecksch et al. | 242/475.1 |
| 5,426,929 | 6/1995 | Schwalm et al. | 242/473.8 X |
| 5,605,296 | 2/1997 | Haasen et al. | 242/475.5 |

FOREIGN PATENT DOCUMENTS

| | | |
|---|---|---|
| OS 21 23 641 | 11/1972 | Germany . |
| 40 04 028 | 8/1991 | Germany . |
| 42 22 377 | 1/1994 | Germany . |
| 42 31 958 | 3/1994 | Germany . |
| 5-246626 | 9/1993 | Japan . |

*Primary Examiner*—Michael R. Mansen

*Attorney, Agent, or Firm*—Kennedy Covington Lobdell & Hickman, LLP

[57] ABSTRACT

A winding unit 2 of an automatic bobbin winder includes a suction nozzle 12 for aspirating from the surface 48 of a take-up bobbin 11 an upper yarn end portion 34 after a yarn break for subsequent placement into a splicing device 13. The suction nozzle 12 has a sensor device 35 for detecting the presence of the aspirated upper yarn and the sensor device is connected to winding unit computer 39. The suction device is connected via a cam transmission 27, 29 to a reversible drive 25 which can be driven by winding-unit computer 39 to cause the mouth 38 of the suction nozzle to execute reciprocatory pitching movements V, Z to assist the nozzle in properly aspirating the upper yarn.

5 Claims, 4 Drawing Sheets

BOBBIN WINDING UNIT OF A TEXTILE MACHINE FOR PRODUCING CROSS-WOUND BOBBINS

BACKGROUND OF THE INVENTION

The invention is relative to a bobbin winding unit of a textile machine for producing cross-wound bobbins, sometimes referred to as cheeses.

Bobbin winding units in textile machines for producing cross-wound bobbins, or cheeses, are equipped typically with a splicing device for connecting an upper yarn to a lower yarn. Such splicing devices utilize a suction nozzle pivoted by an electromotor drive for manipulating the upper yarn between a position in which the suction-nozzle mouth is disposed in the area of the surface of a take-up bobbin for locating the upper yarn and a position in which the upper yarn is placed into the splicing device. The suction nozzle may also have a sensor device for sensing the presence of the upper yarn.

Such bobbin winding units are known, e.g., from Japanese Published, Unexamined application Hei 5-246,626. This publication describes a winding unit for an automatic bobbin winder which unit comprises a suction nozzle which can pivot in a defined manner via an associated individual drive. A sensor device for detecting a sectioned upper yarn is installed inside the suction nozzle. In addition, the maximal yarn search time, that is, the time during which the suction nozzle remains positioned on the surface of a take-up bobbin being wound, can be adjusted via a time function element. If the free end of the upper yarn to be spliced is not found by the sensor device within the preset search time, the yarn search and therewith the attempt at yarn connection is stopped.

DE 42 31 958 A1 describes a winding unit with a yarn connection device which comprises a pivotably mounted multifunctional yarn manipulating element by which both the upper yarn and the lower yarn can be placed in a splicing device. While the yarn manipulating element is directly taking up the lower yarn, the upper yarn is taken up indirectly via an additional flat nozzle. The yarn manipulating element can dock on this flat nozzle for accepting the upper yarn. The flat nozzle is connected to a motor which pivots the flat nozzle during the winding process in such a manner that the nozzle mouth remains in the area of the surface of the take-up bobbin. It is moreover possible to vary the spacing of the mouth of the flat nozzle to the surface of the take-up bobbin by appropriately regulating this motor.

SUMMARY OF THE INVENTION

With the foregoing state of the art discussed above in mind, it is an object of the present invention to further improve the known winding units for textile machines which producing cross-wound bobbin.

The invention achieves this objective by providing an improved winding unit for winding a yarn onto a take-up bobbin in a textile machine for producing cross-wound bobbins. Basically, the winding unit comprises a splicing device for connecting an upper yarn portion to a lower yarn portion, a suction nozzle having a mouth pivotable between a position in the area of the yarn surface of the take-up bobbin for grasping the upper yarn portion and a position for placing the upper yarn portion into the splicing device, and a sensor device associated with the suction nozzle for detecting the presence of the upper yarn portion. According to the present invention, a reversible motor is utilized for driving such pivoting movements of the suction nozzle, and a winding computer is provided for controlling actuation of the motor. The computer is connected to the sensor device to monitor the correct suction grasping of the upper yarn portion and the computer is adapted in the absence of detection of the upper yarn portion by the sensor device to actuate reciprocatory driving of the motor to cause oscillatory pitching motion of the mouth of the suction nozzle in the area of the yarn surface of the take-up bobbin.

This drive arrangement for the suction nozzle in accordance with the present invention assures that yarn loops which can form in the area of the mouth of the suction nozzle, especially on the needle comb arranged in this area, and which can then hinder the proper aspiration the end of the upper yarn into the suction nozzle, are reliably disentangled.

Such yarn loops, which occur in particular in the case of yarns with numerous projecting surface fibers, are disentangled by the pitching movements of the suction nozzle. That is, the needle comb, which is thereby moved away repeatedly from the surface of the take-up bobbin by the pitching motions of the suction nozzle, draws any yarn loops in the direction of the end of the yarn and disentangles them as a result thereof. The pitching movements of the suction nozzle are produced by appropriately regulating the reversible drive connected to the suction nozzle. The drive is initiated by the winding-unit computer as a function of a negative signal. of the sensor device integrated in the suction nozzle. That is, if the sensor device does not detect any starting end of an aspirated yarn the reversible drive is actuated.

In a preferred embodiment the sensor device is designed as an optical yarn sensor which, as is customary, comprises a light source as well as a photoelectric receiver component, e.g. a phototransistor, a photodiode or a photoresistor. In such sensor devices, known e.g. from DE-OS 21 23 641, an end of a yarn extending in the area between the light source and the receiver component results in a shadow on the receiver component which is converted in the receiver component into an electric signal which is passed on via a signal lead to the winding-unit computer. If the winding-unit computer does not receive such a signal within a predetermined time span, during which the mouth of the suction nozzle is positioned in the area of the surface of the take-up bobbin, the absence of such a signal is interpreted by the winding-unit computer to mean that the upper yarn either was not able to be sectioned or was sectioned in the form of a yarn loop which has become fixed in the needle comb of the mouth of the suction nozzle (which as indicated occurs in particular in the case of yarns having projecting surface fibers). The winding-unit computer reacts to the negative signal. of the sensor device by actuating the reversible drive.

A further feature of the invention provides that the suction nozzle is connected to the reversible drive via a cam-disk transmission having a guide contour which makes it possible to rotate the cam disk both clockwise and also counterclockwise. Specifically, a cam lever has a follower roller resting on the guide contour of the cam disk and is connected to a toothed rim on the suction nozzle (e.g., via a corresponding tooth segment) so as to be moved up and down by reversing the drive, which movement is transmitted to the suction nozzle as pitching movements. A device designed in this manner can not only be pivoted very exactly via the setting of the angle of rotation of the drive but is also distinguished by a high degree of reliability and a long service life.

In an advantageous aspect of the invention, the dwell time during which the mouth of the suction nozzle is positioned in the area of the take-up surface on the winding bobbin can be adjusted by the winding-unit computer. That is, by an appropriate adaptation of the stop times of the reversible drive to the given winding conditions, in particular when taking into account the yarn material present, it is possible to minimize the time required for suctioning the upper yarn, which has a positive effect on the duration of the yarn-connection process and thus results in a further improvement of the efficiency of the automatic bobbin winder.

Further details of the invention will be explained and understood from an exemplary embodiment described below with reference to the accompanying drawings.

DESCRIPTION OF THE PREFERRED EMBODIMENT

Figure 1:
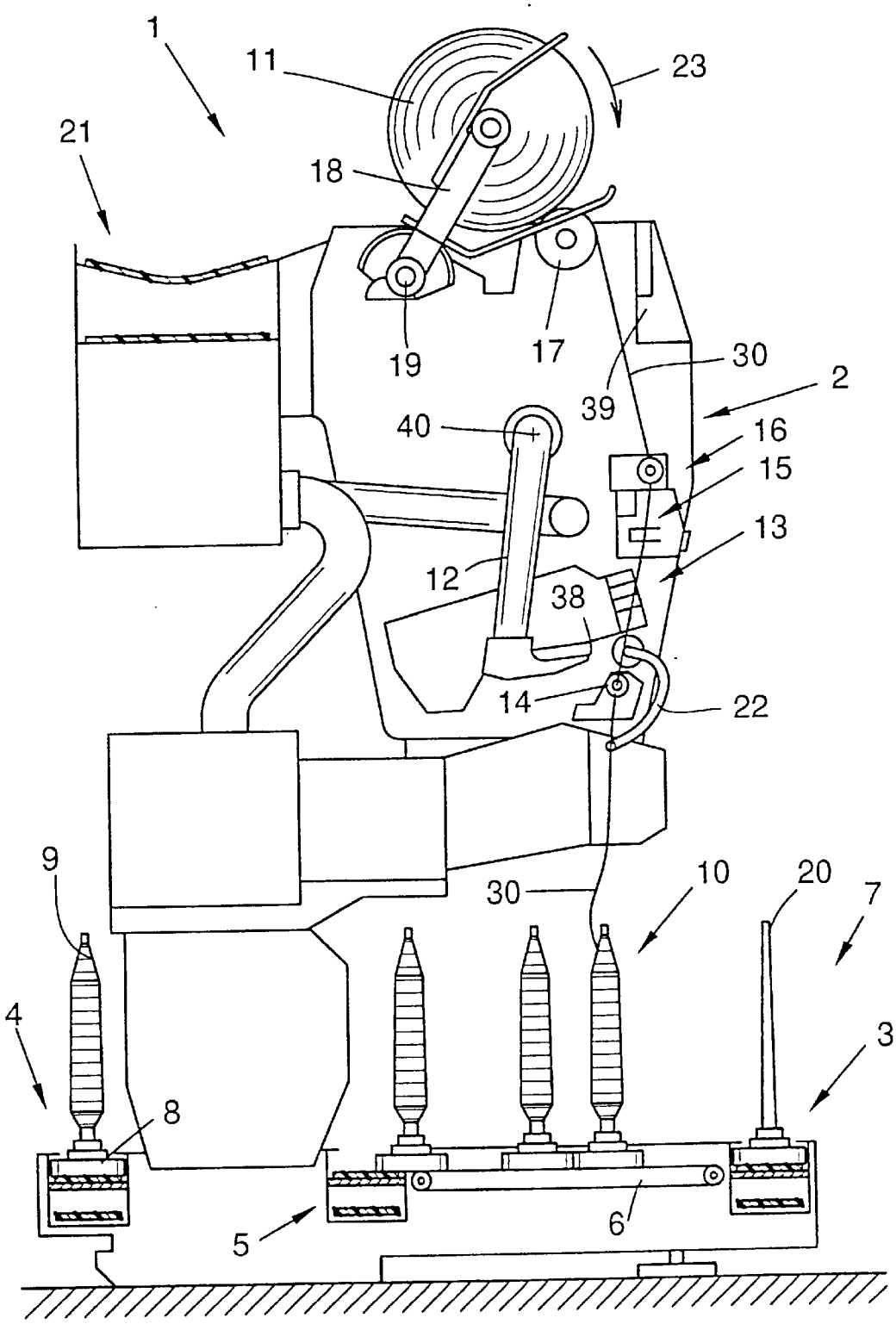
FIG. 1 is a side elevational view of a winding unit of a textile machine for producing cross-wound bobbins depicting the normal winding process.

Referring now to the accompanying drawings, FIG. 1 is a lateral view of a winding unit 2 of an exemplary automatic bobbin winder of the type in which the present invention is preferably embodied, indicated in its entirety by reference numeral 1, showing the operation of yarn winding for producing cross-wound bobbins.

Such automatic bobbin winders usually comprise a plurality of similar winding units 2 at which spinning cops 9 produced on a ring spinning machine (not shown) are rewound into larger-volume take-up bobbins, so-called cross-wound bobbins. The finished cross-wound bobbins 11 are rolled laterally onto a cross-wound bobbin transport device 21 by an automatically operating service unit and then transported to a bobbin loading station or the like located at one end of the machine (not shown).

Figure 2:
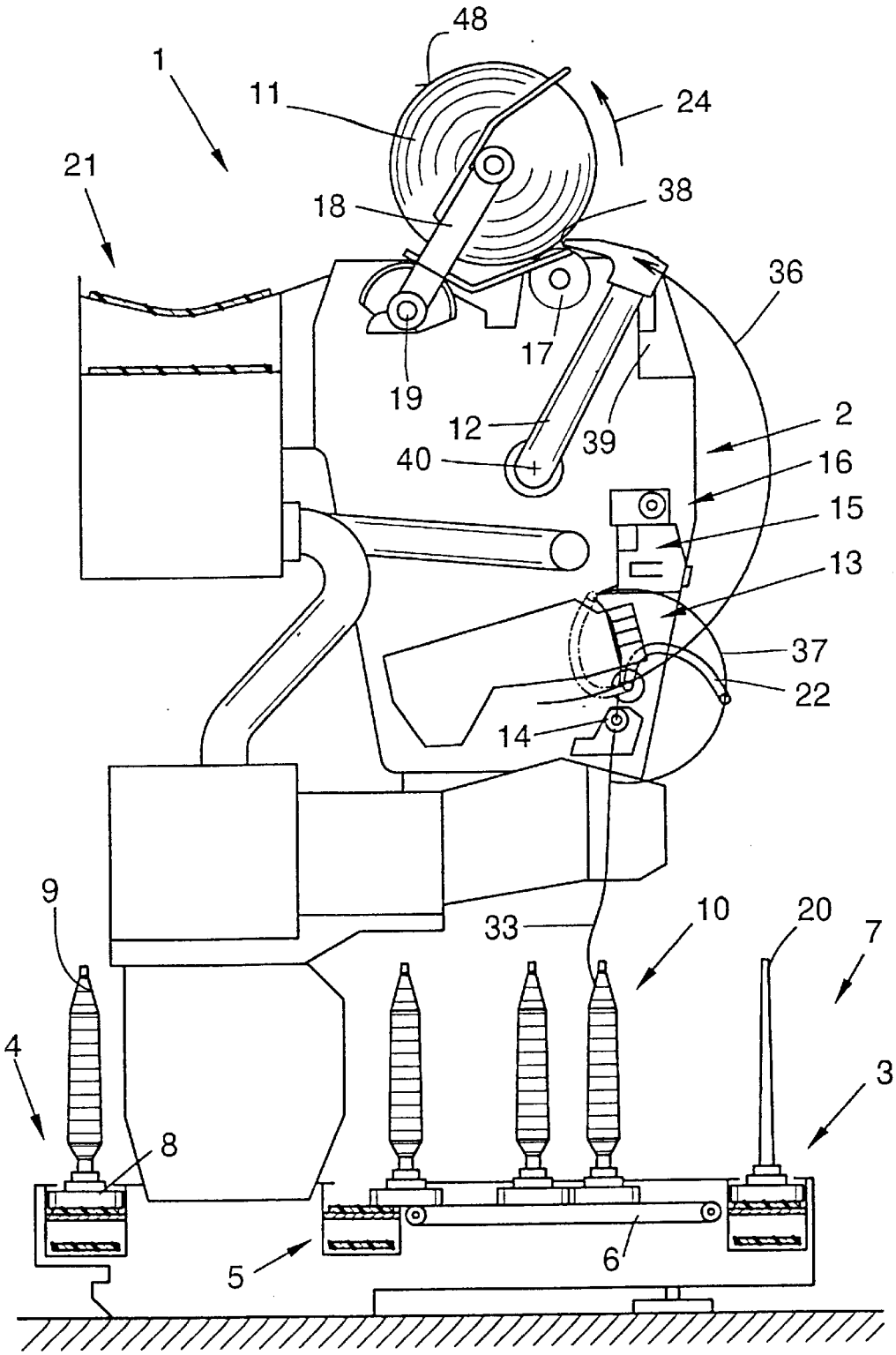
FIG. 2 is another side elevational view of the winding unit of FIG. 1 depicting the start of a splicing procedure, e.g., for reconnecting a broken yarn.

Such automatic bobbin winders also comprise as a rule a logistics device in the form of a bobbin and tube transport system 3. Spinning cops 9 and empty tubes 20 circulate on transport plates 8 in this bobbin and tube transport system 3. Of this extensive transport system 3, only a cop supply transport track 4 extending the length of the machine, a reversing track 5 extending behind the winding units 2, one of multiple transversal transport tracks 6 associated respectively with the winding units 2 and a tube return track 7 are shown in FIGS. 1 and 2.

Spinning cops 9 are delivered along the tracks 4, 5, 6 to unwinding positions 10 located respectively along the transversal transport tracks 6 from which the yarn on the cops 9 is unwound and then subsequently rewound into cross-wound bobbins 11. The individual winding units 2 comprise various known devices which thereby assure an orderly operation of these work positions.

In FIG. 1, 30 indicates the yarn traveling from a spinning cop 9 in the unwinding position to a cross-wound bobbin 11, 12 represents a suction nozzle, 22 represents a grasping tube, 13 represents a splicing device, 14 represents a yarn tensioning device, 15 represents a yarn cleaner with yarn cutting device and 16 represents a paraffin applying device. A bobbin drive drum which drives cross-wound bobbin 11 by friction contact in the direction of arrow 23 during the winding operation is indicated by reference numeral 17. During the winding operation, the cross-wound bobbin 11 is held in a creel 18 mounted so that it can pivot about a shaft 19. A pivoting sheet is located below creel 18, which can likewise rotate in a limited manner about the pivoting shaft 19, whereby the finished cross-wound bobbins 11 can be transferred via the pivoting sheet onto the cross-wound bobbin transport device 21 arranged behind winding units 2.

As has already been briefly indicated, winding units 2 are serviced via a service unit, a so-called cross-wound bobbin replacer, to assure that cross-wound bobbins 11 which have attained a predetermined diameter are discharged onto the bobbin transport device 21 and that an empty tube is subsequently placed in exchange into creel 18 from an empty-tube magazine.

FIG. 2 shows the situation in a winding unit 2 at which an interruption of winding has occurred, e.g. if a yarn cleaner 15 has cut the traveling yarn 30 on account of a detected yarn error. In this instance, the cut end of yarn trailing from the bobbin being wound, herein referred to as the upper yarn 34, winds onto the surface 48 of cross-wound bobbin 11, while the leading end of yarn being withdrawn from the cop at the unwinding station, herein referred to as the lower yarn 33, is normally clamped in a yarn tensioner 14 and held ready for a following yarn splicing procedure to reconnect the yarn ends so that winding can resume.

FIG. 2 shows the point in time at the start of the yarn connection process. Suction nozzle 12 has already been pivoted into its upper position and attempts to grasp by suction the upper yarn 34 lying on the surface 48 of the cross-wound bobbin 11. The cross-wound bobbin is rotated during this time, as shown by arrow 24, counter to its normal direction of winding rotation. Another yarn grasping tube 22, which has already grasped the lower yarn 33 with the grasping-tube flap (not shown), is standing in a waiting position, as shown.

Figure 3:
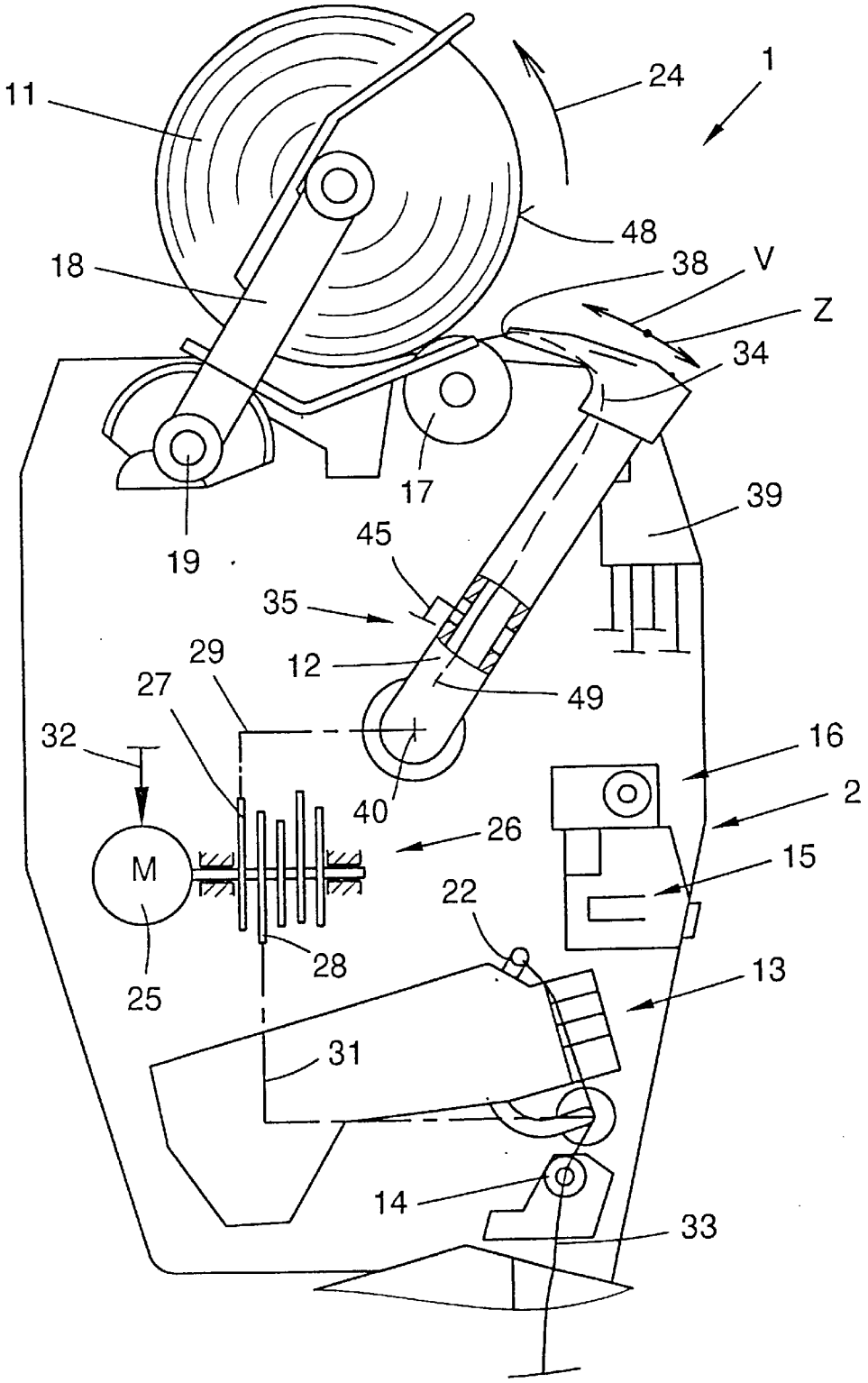
FIG. 3 is a more enlarged side elevational view of a portion of the winding unit of FIGS. 1 and 2 schematically showing the regulating of the yarn manipulation devices (i.e., the suction nozzle and yarn grasping tube) in accordance with the present invention.

As is indicated in enlarged form and in greater detail in FIG. 3, the suction nozzle 12 and the grasping tube 22 are connected to a reversible electrodrive 25 via operative connections, preferably by respective cam levers 29 and 31 connected to respective cam disks 27 and 28 of a cam-disk packet 26. Reversible drive 25 is connected via a control lead 32 to a winding-unit computer 39 of the particular winding unit 2.

FIG. 3 also shows that a sensor device 35, preferably an optical yarn sensor, is integrated into the suction nozzle 12 to detect the presence of the end of the yarn 38 forming the upper yarn 34 and the sensor device 35 is also connected via a signal lead 45 to the winding-unit computer 39.

Figure 4:
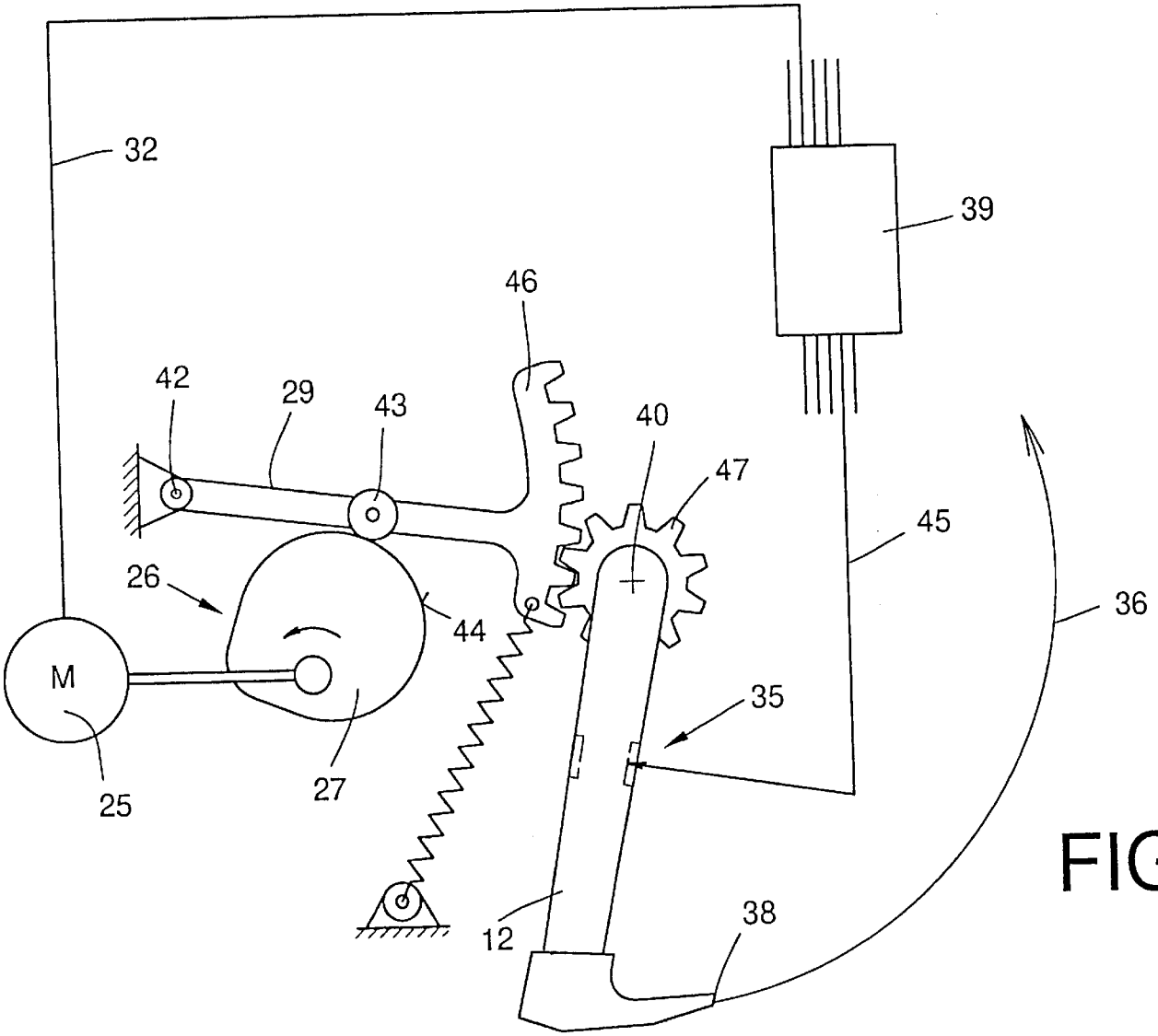
FIG. 4 is an elevational view of the drive device for the suction nozzle for receiving the upper yarn on a larger scale.

FIG. 4 schematically shows a preferred embodiment of the suction-nozzle drive device. As is schematically shown, the reversible drive 25 is connected via a control lead 32 to the winding-unit computer 39 and thereby drives the cam-disk packet of which only cam disk 27 is shown. A follower roller 43 is mounted on cam lever 29 in resting engagement on the peripheral guide contour 44 of this cam disk 27 so that the lever 29 can pivot about shaft 42. The outer free end of the cam lever 29 is formed with a toothed segment 46 which meshes with a corresponding toothed rim 47 mounted on the suction nozzle 12 for rotation about its pivoting shaft 40.

The operation of the present invention may thus be understood. If a winding interruption occurs during the normal winding process shown in FIG. 1, e.g., because the yarn is broken or because the yarn cleaner 15 monitoring the traveling yarn 30 has recognized an unacceptable yarn defect and has thereupon activated its yarn cutting device, the lower yarn 33 is clamped in the yarn tensioner 14 below the yarn cleaner 15 and held in a ready state therein awaiting the following yarn connection procedure. On the other hand, the upper yarn 34, which in the case of a yarn cut initiated by the yarn cleaner 15 contains the yarn defect, is wound onto the surface 48 of the bobbin 11, which has been raised by drive roller 17 and braked to a standstill.

In order to aspirate the upper yarn 34 from the surface 48 of the take-up bobbin 11, the suction nozzle 12 is pivoted out of the initial position indicated in FIG. 1 along a circular arc 36 into a position in which the mouth 38 of the suction nozzle 12 is positioned at the surface 48 of the take-up bobbin 11, which is slowly rotated in an unwinding direction 24 opposite that during normal winding operation. Normally, the suction nozzle 12 remains in such position for a brief time (0.5 to 1 sec.) and then pivots back into its lower initial position after the sensor device 35 integrated into the suction nozzle 12 has detected the aspirated trailing end 49 of upper yarn 34, whereby the upper yarn 34 is placed into the splicing device 13.

The lower yarn 33 is also subsequently placed into the splicing device 13 by the grasping tube 22, which is also pneumatically loaded to apply suction to the lower yarn 33. Grasping tube 22 pivots thereupon along a circular arc 37 out of its initial position into the yarn insertion position shown in dotted lines in FIG. 2. The successful insertion of lower yarn 33 into splicing device 13 can be monitored by a lower-yarn sensor (not shown). After any yarn defect has been removed, the upper yarn 34 is connected to the lower yarn 33 in splicing device 13.

If the upper yarn 34 was not able to be grasped or was not properly grasped by the suction nozzle 12 within a given time span and, accordingly, no signal has been transmitted from the sensor device 35 to the winding-unit computer 39, the reversible drive 25 is actuated via control lead 32 to cause the suction nozzle 12 to execute reciprocatory pitching movements V, Z (see FIG. 3). Specifically, the drive 25 rotates the cam-disk packet 26 and therewith the cam disk 27 back and forth so that the cam lever 29, which rests with its roller 43 on the guide contour 44 of the cam disk 27, is moved up and down. This up-and-down motion of cam lever 29 is transmitted, in turn, to suction nozzle 12 as pitching movements V, Z.

Yarn loops or the like which may have been caught in a needle comb arranged in the area of the suction-nozzle mouth 38 (not shown) are drawn out by the pitching movements of the suction nozzle 12 and its suction-nozzle mouth 38 whereby the yarn end 49 of upper yarn 34 is released to be aspirated by the prevailing suction fully into suction nozzle 12.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In a textile machine for producing cross-wound bobbins, a winding unit for winding a yarn onto a take-up bobbin having a yarn surface, the winding unit comprising;

a splicing device for connecting an upper yarn portion to a lower yarn portion, a suction nozzle having a mouth and being pivotable between a take-up position whereat said mouth is disposed in the area of the yarn surface of the take-up bobbin for grasping the upper yarn portion, and a lower position whereat the upper yarn portion grasped by said mouth is placed into said splicing device, a sensor associated with said suction nozzle for detecting the presence of the upper yarn portion, and means for causing small oscillatory motion of said mouth adjacent the yarn surface of the take-up bobbin if said sensor does not detect the upper yarn portion when said suction nozzle is in the take-up position.

2. The winding unit according to claim 1, wherein said sensor comprises an optical yarn sensor integrated into said suction nozzle.

3. The winding unit according to claim 1, wherein said means includes a reversible drive motor, a cam disk having a guide contour and being connected to said reversible drive motor for opposed rotary clockwise and counterclockwise motion of said cam disk, and a cam lever connected to said suction nozzle and disposed in following relation to said guide contour for transmitting rotary motion of said cam disk into said small oscillatory motion of said mouth.

4. The winding unit according to claim 1, wherein said means includes a reversible drive motor and a computer for controlling actuation of said motor, and wherein said computer is adapted to pause said drive motor for a predetermined dwell time when said mouth of said suction nozzle is in the area of the yarn surface of the take-up bobbin.

5. A method for aspirating an upper yarn portion from a yarn surface of a take-up bobbin at a winding unit of a textile machine used to produce cross-wound bobbins, the method comprising:

pivoting a suction nozzle having a mouth into a take-up position whereat the mouth of the suction nozzle is disposed in an area of the yarn surface of the take-up bobbin for grasping the upper yarn portion, sensing the presence of the upper yarn portion within the suction nozzle when in the take-up position, and driving small oscillatory movement of the mouth of the suction nozzle adjacent the yarn surface of the take-up bobbin if the presence of the upper yarn portion is not detected.

* * * * *